United States Patent [19]

Berger et al.

[11] 4,386,151

[45] May 31, 1983

[54] DIFFUSION TRANSFER FILM SYSTEM WITH PROTECTIVE LAYER OF COPPER SALT, CHITOSAN AND SELECTED POLYOLS

[75] Inventors: Michael Berger, Chestnut Hill, Mass.; Charles H. Byers, Oak Ridge, Tenn.; John J. Magenheimer, Wellesley, Mass.

[73] Assignee: Polaroid Corporation, Cambridge, Mass.

[21] Appl. No.: 400,906

[22] Filed: Jul. 22, 1982

Related U.S. Application Data

[63] Continuation-in-part of Ser. No. 277,946, Jun. 26, 1981, abandoned.

[51] Int. Cl.[3] ..... G03C 5/54; G03C 1/48; G03C 7/00

[52] U.S. Cl. ..... 430/228; 430/227; 430/231; 430/244; 430/245; 430/262; 430/263

[58] Field of Search ..... 430/227, 228, 231, 244, 430/245, 262, 263

[56] References Cited

U.S. PATENT DOCUMENTS 3,674,482 7/1972 Hablerin ..... 430/228
4,056,392 11/1977 Scott ..... 430/227

*Primary Examiner*—Richard L. Schilling
*Attorney, Agent, or Firm*—Philip G. Kiely

[57] ABSTRACT

A silver diffusion transfer film unit which comprises, in order, a support, a silver precipitating layer, a protective layer comprising chitosan having a copper salt and a polyol selected from the group consisting of glycerol, sorbitol, polyvinyl alcohol, inositol, ethylene glycol, propylene glycol and hydroxyethyl cellulose disposed therein, a release layer, and a photosensitive silver halide layer. In a particularly preferred embodiment, the film unit is an additive color diffusion transfer film unit.

25 Claims, 11 Drawing Figures

DIFFUSION TRANSFER FILM SYSTEM WITH PROTECTIVE LAYER OF COPPER SALT, CHITOSAN AND SELECTED POLYOLS

CROSS-REFERENCE TO RELATED APPLICATION

This application is a continuation-in-part of copending application Ser. No. 277,946, filed June 26, 1981, now abandoned.

BACKGROUND OF THE INVENTION

Procedures for preparing photographic images in silver by diffusion transfer principles are well known in the art. For the formation of the positive silver images, a latent image contained in an exposed photosensitive silver halide emulsion is developed and almost concurrently therewith a soluble silver complex is obtained by reaction of a silver halide solvent with an unexposed and undeveloped silver halide of said emulsion. The photosensitive silver halide emulsion is developed with a processing composition which may be spread between the photosensitive element comprising the silver halide emulsion and a second element which may comprise a suitable silver precipitating layer. The processing composition effects development of the latent image in the emulsion and substantially contemperaneous therewith forms a soluble silver complex, for example, a thiosulfate or thiocyanate, with undeveloped silver halide. This soluble silver complex is at least in part transported in the direction of the print receiving layer and the silver thereof is precipitated in the silver precipitating element to form a positive image. Procedures of this description are disclosed, for example, in U.S. Pat. No. 2,543,181 issued to Edwin H. Land. See also Edwin H. Land, *One Step Photography,* Photographic Journal, Section A, pgs. 7–15, January 1950.

Additive color reproduction may be produced by exposing a photosensitive silver halide emulsion through an additive color screen having filter media or screen elements each of an individual additive color such as red or green or blue and by viewing the reversed or positive silver image formed by transfer to a transparent print receiving element through the same or a similar screen which is suitably registered with a positive image carried in the print receiving layer. As examples of suitable film structures for employment in additive color photography, mention may be made of U.S. Pat. Nos. 2,861,885; 2,726,154; 2,944,894; 3,536,488; 3,615,426; 3,615,427; 3,615,428; 3,615,429; 3,894,871.

U.S. Pat. No. 3,674,482 issued July 4, 1972, is directed to a silver diffusion transfer film unit which comprises a support carrying on one surface, in order, a layer containing a silver precipitating nuclei, an inert non-nuclei containing protective layer and a layer containing a photosensitive silver halide emulsion. The purpose of the non-nucleated protective layer is to provide a layer over the transferred silver image after the emulsion layer has been removed subsequent to processing, which protective layer will then be the outermost layer. The material for the protective layer is one which is readily permeable to the processing composition and which will not provide sites for the nucleation of the silver forming the transferred image. A particularly preferred material employed as a protective layer comprises chitosan (deacetylated chitin).

U.S. Pat. No. 4,056,392 issued Nov. 1, 1977 is directed to a diffusion transfer film unit which comprises, in order, an additive color screen, a layer comprising silver precipitating nuclei, a layer comprising a water-soluble cupric salt and a compound selected from the group consisting of chitosan and 2-amino-2-deoxyglucose, and a photosensitive silver halide emulsion layer. By employing a water-soluble copper salt in the chitosan protective layer, an increase in $D_{max}$ is achieved with substantially no adverse effect on $D_{min}$ compared to a protective layer composed of chitosan alone.

SUMMARY OF THE INVENTION

The present invention is directed to a silver diffusion transfer film unit which comprises, in order, a support, a layer comprising silver precipitating nuclei, a protective layer comprising chitosan, a water-soluble salt of copper and a polyol, selected from the group consisting of glycerol, sorbitol, polyvinyl alcohol, inositol, ethylene glycol, propylene glycol and hydroxyethyl cellulose, a release layer, and a photosensitive silver halide emulsion layer. It should be understood that whenever a reference is made to a water-soluble salt of copper, the copper is added in the cupric valance state.

In a particularly preferred embodiment, the film unit is an additive color diffusion transfer film unit wherein the aforementioned support would carry an additive color screen.

DETAILED DESCRIPTION OF THE INVENTION

Figure 1:
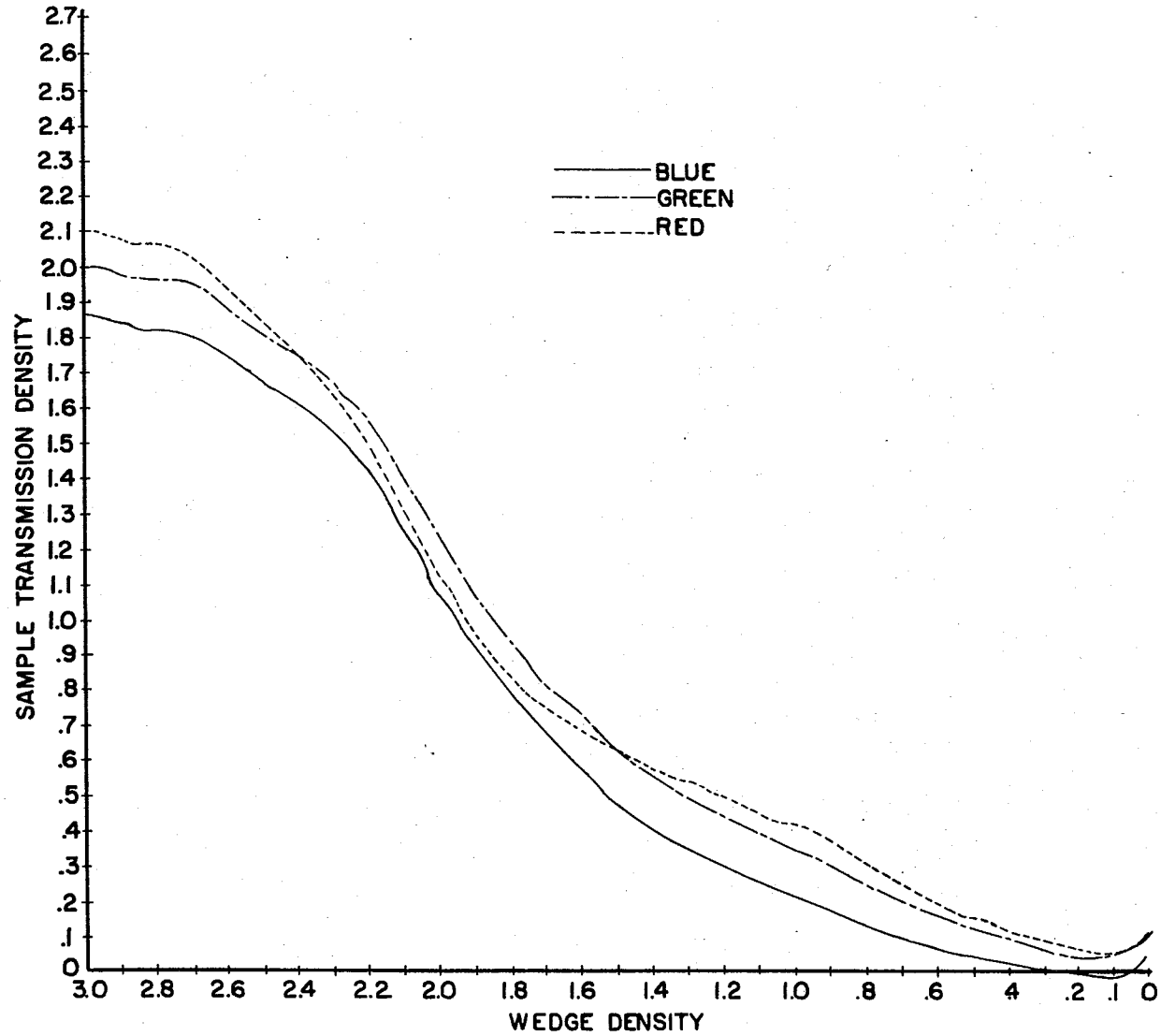
FIGS. 1–11 are H&D curves derived from the film units of Examples 1–11, respectively.

The above mentioned patents describe the importance of the protective layer when the emulsion layer and other layers are detached from that portion of the film unit containing the positive silver image. The silver image must be protected from physical damage which may occur in processing the film unit or projection of the positive image. It is believed, however, that during storage of film units containing the copper-chitosan protective layer, a change in the chitosan occurs, probably an internal cross-linking. Thus, the protective layer may become, in effect, a barrier and inhibit the transfer of the soluble silver complex to the silver precipitating layer and not only increase processing composition imbibition times necessary to form a suitable transfer image but can also prevent sufficient silver complex from transferring to form an image of desired density.

It has now been found that substantial benefits are obtained in film units of the present invention which employ as a protective layer chitosan, copper and the defined polyol.

The employment of the polyol provides advantages in forming the protective layer. Thus, when combined with the polyol, the chitosan becomes a better film former and is easier to coat. Relatively thick protective layers can be employed without significant impairment of the sensitometric properties. Still further, it is believed that the employment of the polyol enhances the long term stability and integrity of the protective layer.

Substantially any water-soluble salt of copper may be employed in the present invention. Since it is the cupric ion which is believed to be the active moiety the anion is not critical. However, care should be taken that an anion which would be detrimental to the photographic process not be employed. As used herein, reference to cupric ion indicates the valance state of the copper salt when it is added to the materials forming the protective layer. It should be understood that while the copper is added as the cupric ion, it is not known if any valance change occurs in the protective layer by the action of the other materials in the protective layer. In a preferred embodiment the water-soluble salt employed in the present invention is copper acetate or copper gluconate.

The coverage of the protective layer may range from about 2 to 50 mg/ft$^2$.

The ratio of the components of the protective layer may vary over a relatively wide range. In a preferred embodiment, the composition of the protective layer may comprise chitosan ranging from about 1–20 mg/ft$^2$, copper ion ranging from about 0.1–4 mg/ft$^2$ and polyol from about 0.5–10 mg/ft$^2$. The preferred ratio of chitosan to copper ion is about 10 to 1.

In a particularly preferred embodiment, the polyol employed in the protective layer of the present invention is glycerol, if a non-polymeric polyol is desired, or hydroxyethyl cellulose, if a polymeric polyol is desired.

Any suitable release layer known to the art may be employed with the protective layers of the present invention; however, they are particularly suited for use with the release layers disclosed and claimed in copending application of Michael Berger, Warren J. Dillman and Herbert L. Fielding, Ser. No. 277,616 and copending application of Michael Berger and John J. Magenheimer, Ser. No. 277,921, both filed June 26, 1981 (common assignee).

The following nonlimiting example illustrates the novel film units of the present invention.

EXAMPLE A

A film unit was prepared comprising a transparent polyester film base and carrying on one surface an additive color screen of approximately 1500 lines each per inch of red, blue, and green filter screen elements in repetitive side by side relationship; a 2.3$\mu$ polyvinylidine chloride/polyvinyl formal layer, a nucleating layer comprising palladium nuclei at a coverage of about 0.23 mgs/ft$^2$ of palladium (prepared according to the procedure of copending application Ser. No. 80,691 filed Oct. 1, 1979, now U.S. Pat. No. 4,281,056, issued July 28, 1981); 0.23 mgs/ft$^2$ of gelatin and 1.0 mgs/ft$^2$ of hydroxyethyl cellulose; a protective layer as described below; a release layer comprising a mixture of 6 mg/ft$^2$ hydroxyethyl cellulose and 2 mg/ft$^2$ polyethylene emulsion having particles about 0.01 to 0.02$\mu$ in diameter; a panchromatically sensitized gelatino silver iodobromide emulsion at a silver coverage indicated below; a top coat comprising gelatin, antihalation dyes and about 15 mg/ft$^2$ of 3$\mu$ silica particles.

Film units described above were prepared employing the protective layers and silver coverages designated below. The film units were exposed at 4 mcs with a daylight balanced Xenon flash to a multi-color target and processed with mechanical rollers at a 0.0018 in. gap disposing Processing Composition A between the top coat and a stripping sheet comprising a polyester support carrying a layer comprising 500 mg/ft$^2$ gelatin and 50 mg/ft$^2$ zinc acetate. The film was held in the dark for three minutes and the top coat and emulsion layers were removed with the stripping sheet. Example 7 was processed at a 0.0020 in. gap with Processing Composition B and held in the dark for 1 min.

Figure 2:
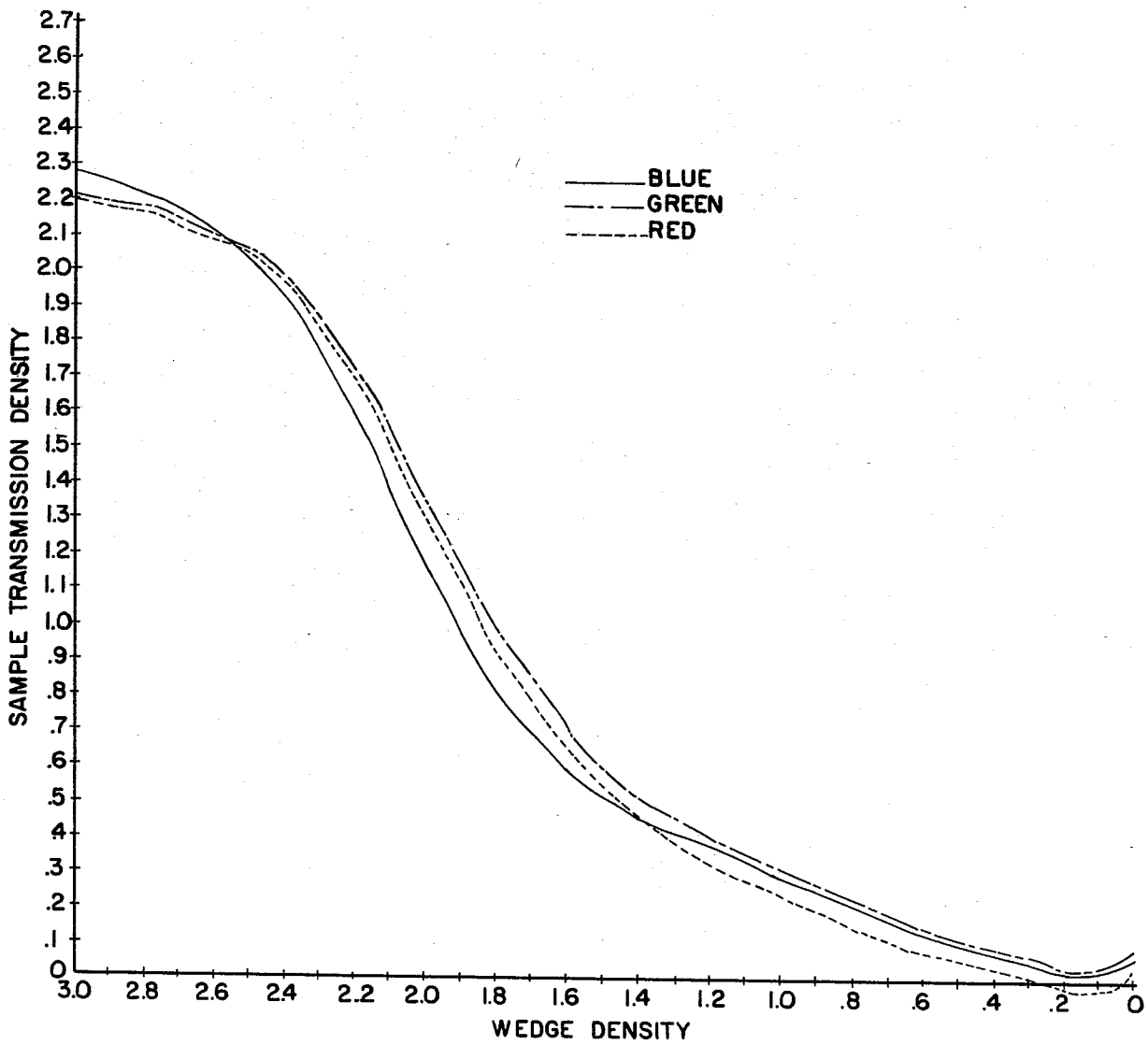
Figure 3:
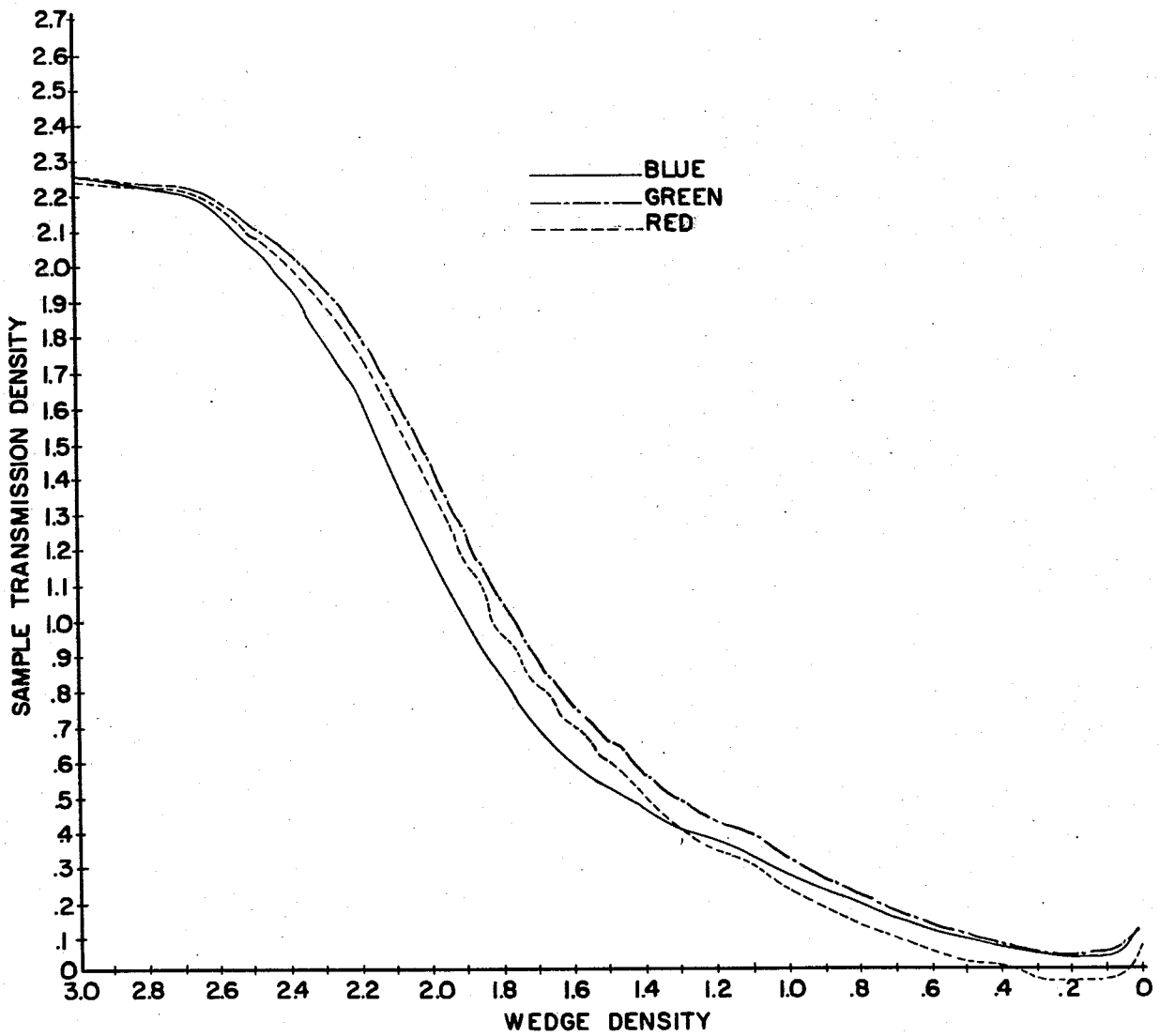
Figure 4:
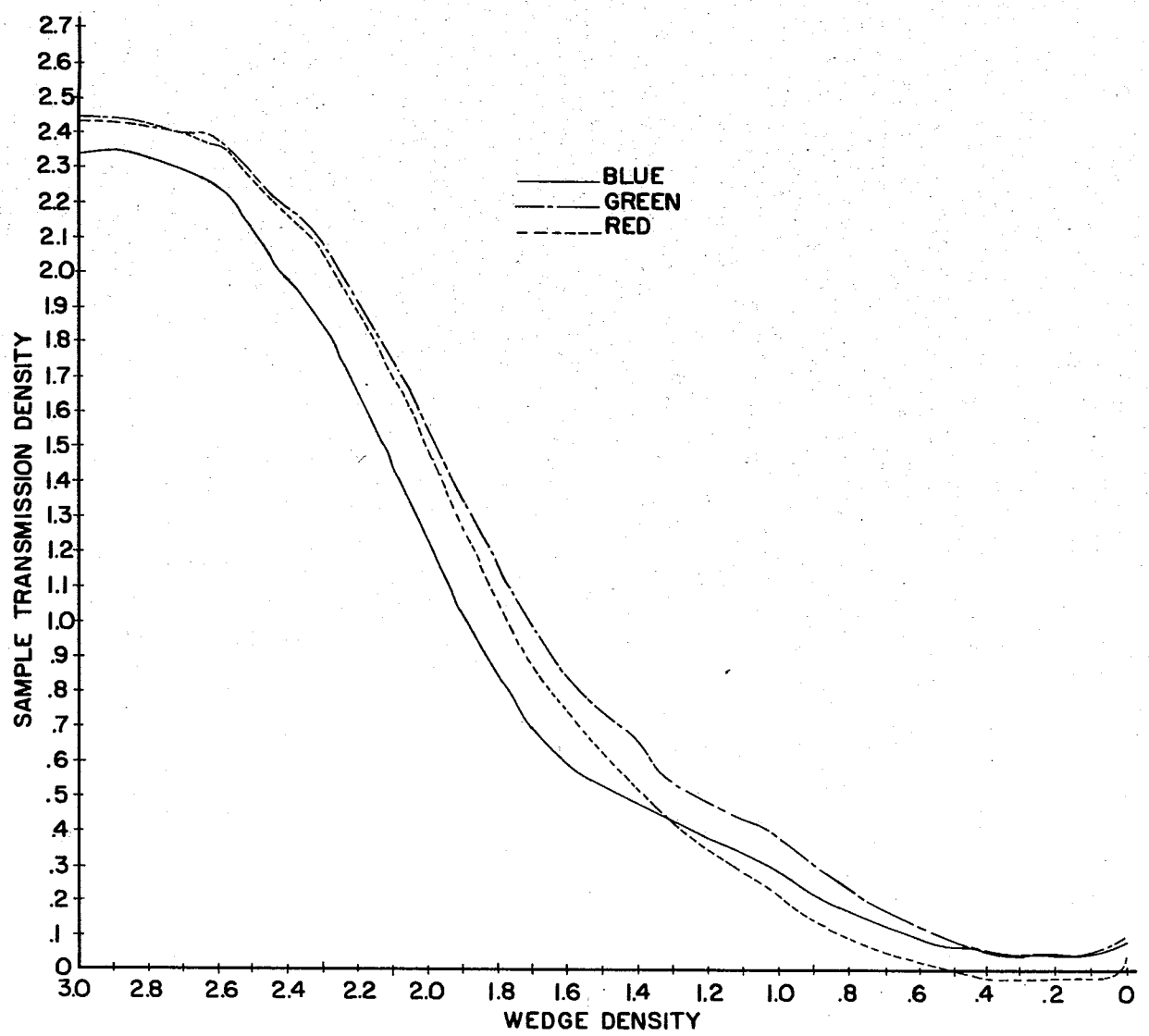
Figure 5:
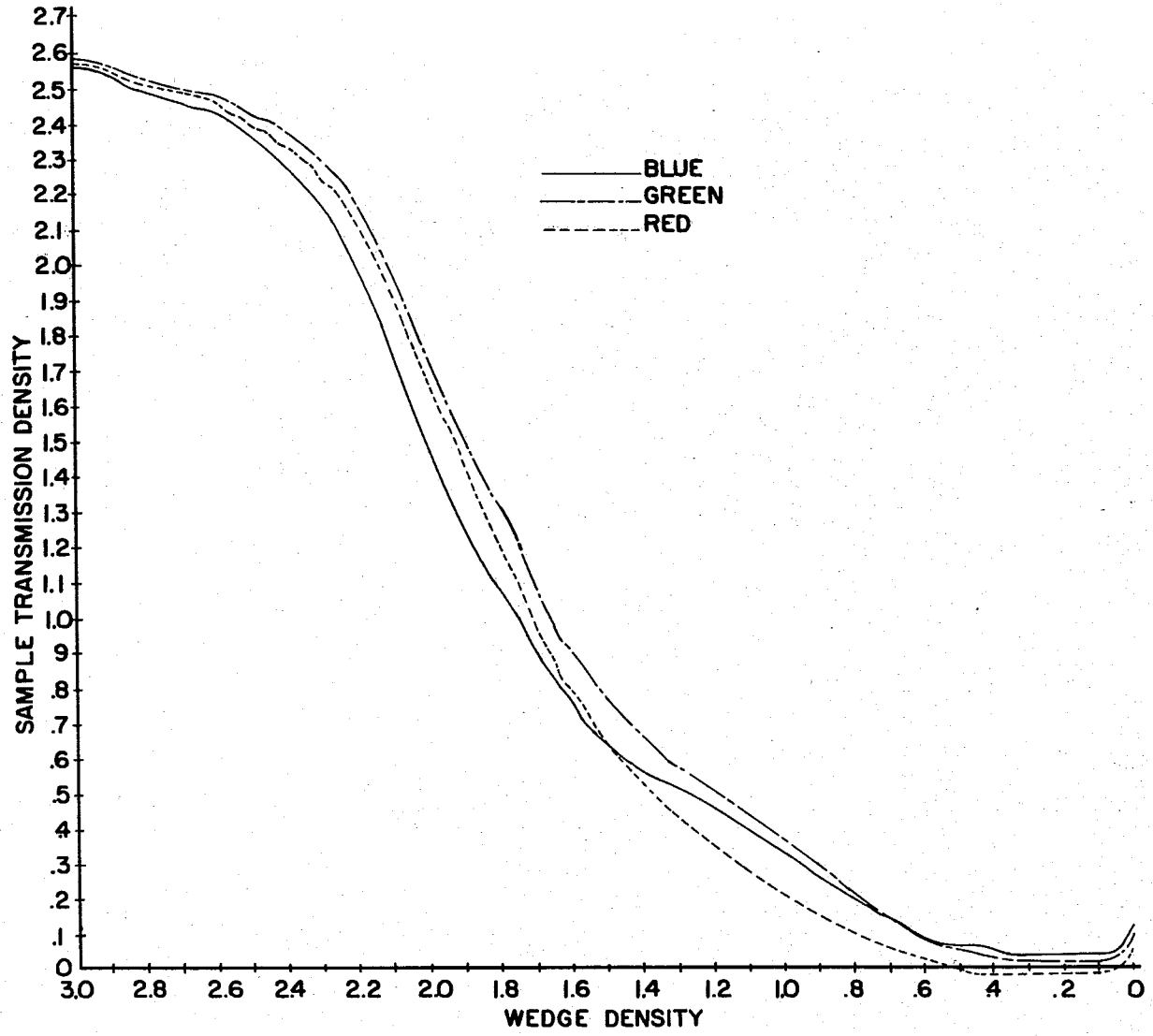
Figure 6:
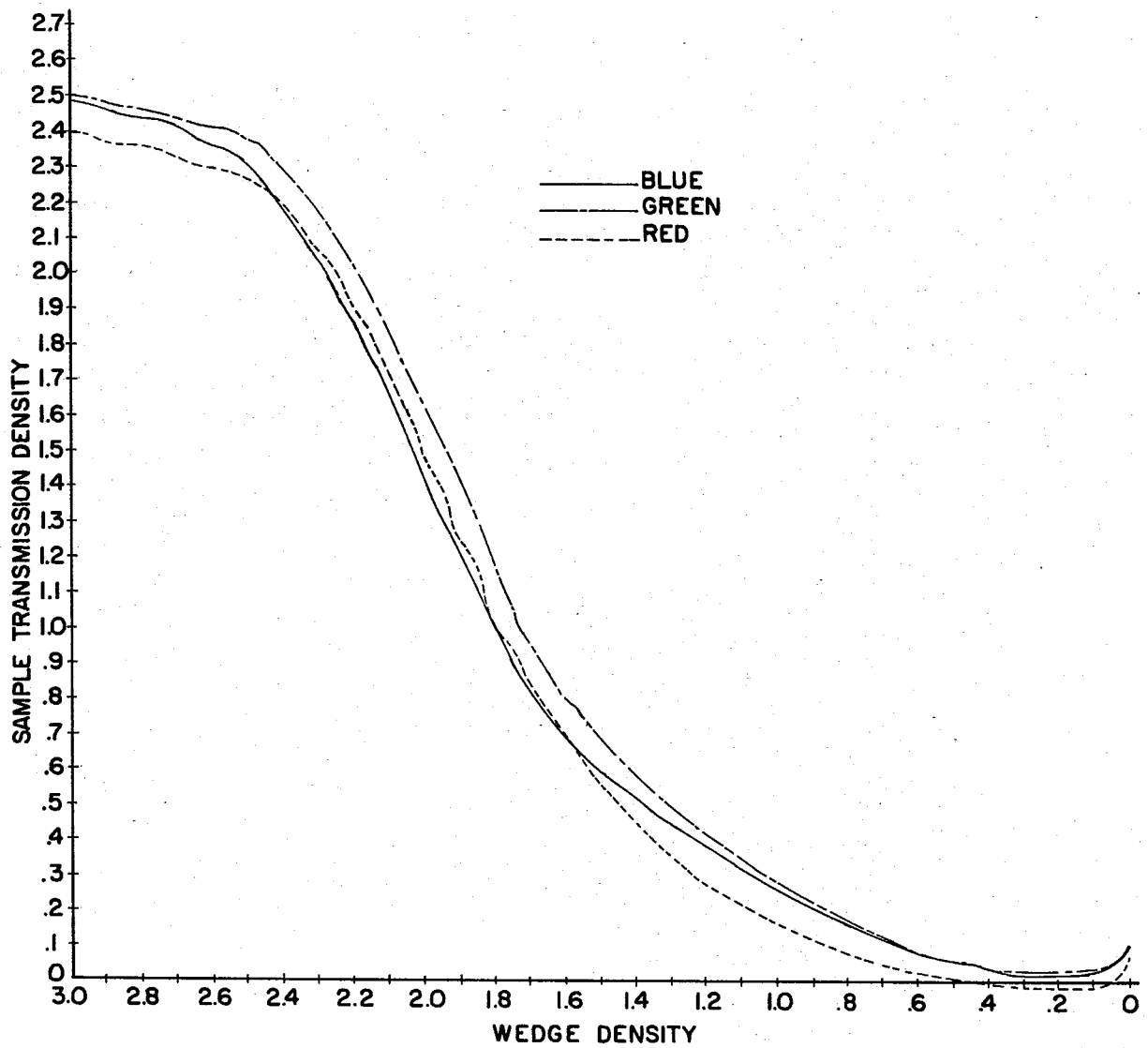
Figure 7:
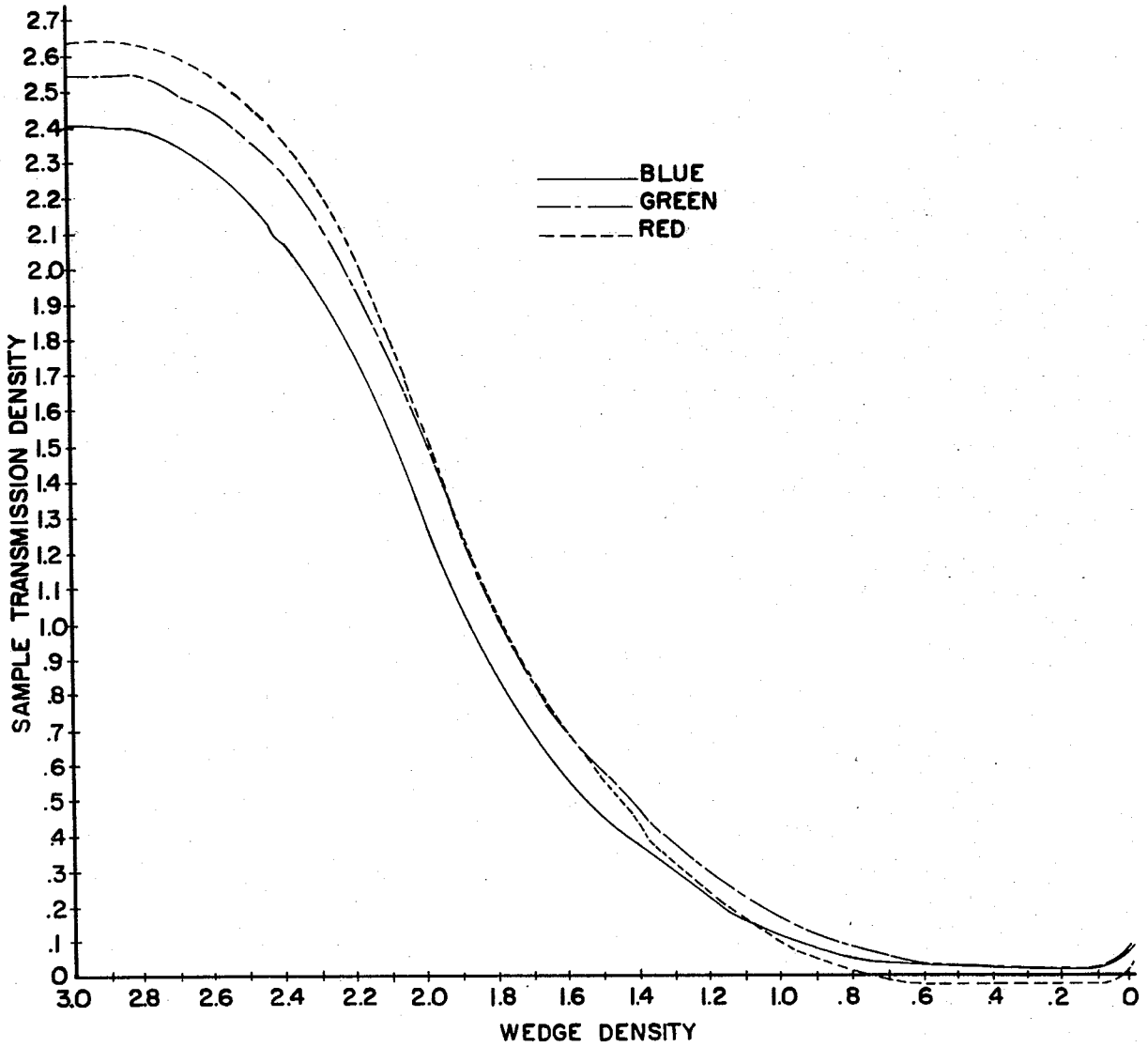
Figure 8:
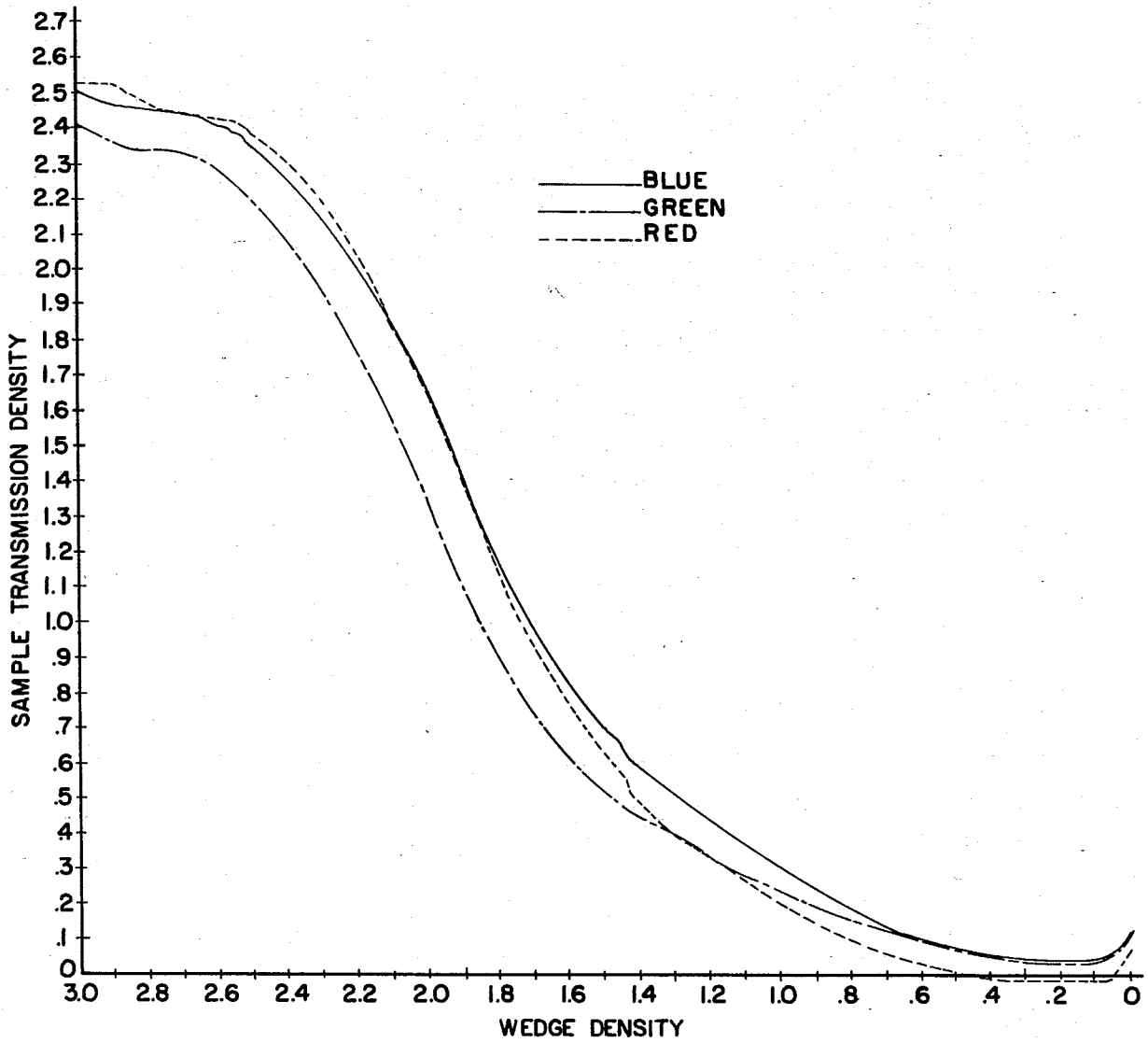
Figure 9:
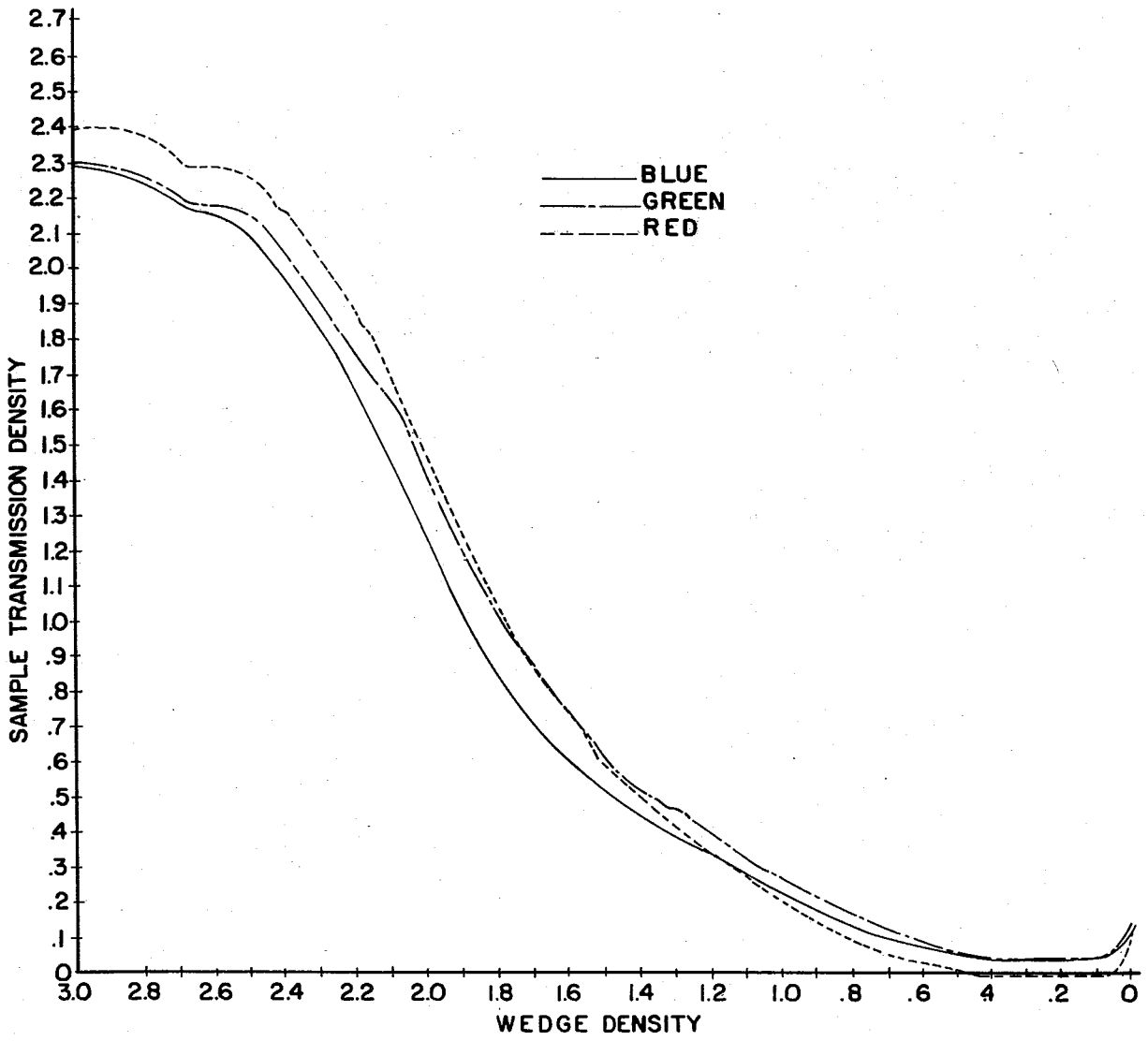
Figure 10:
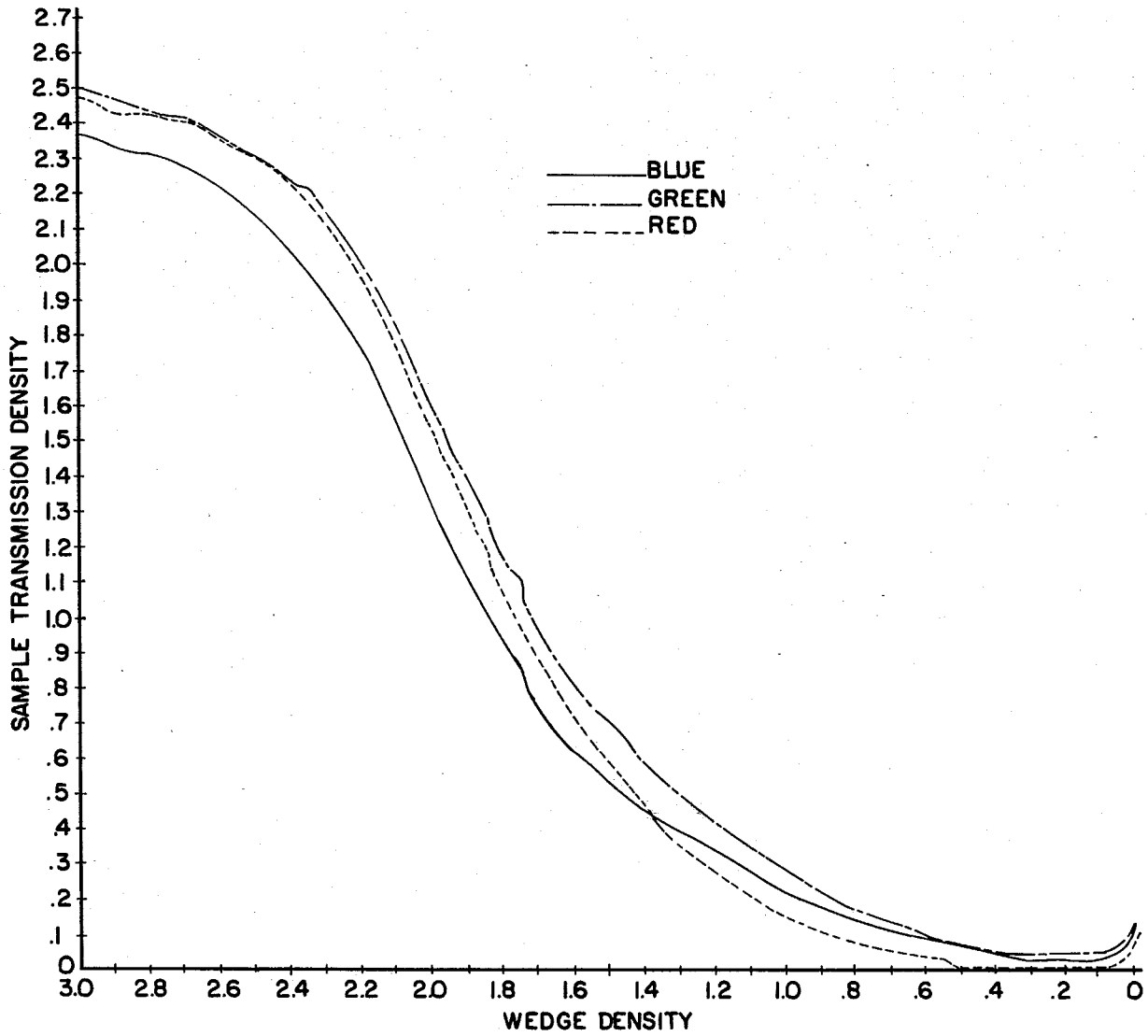
Figure 11:
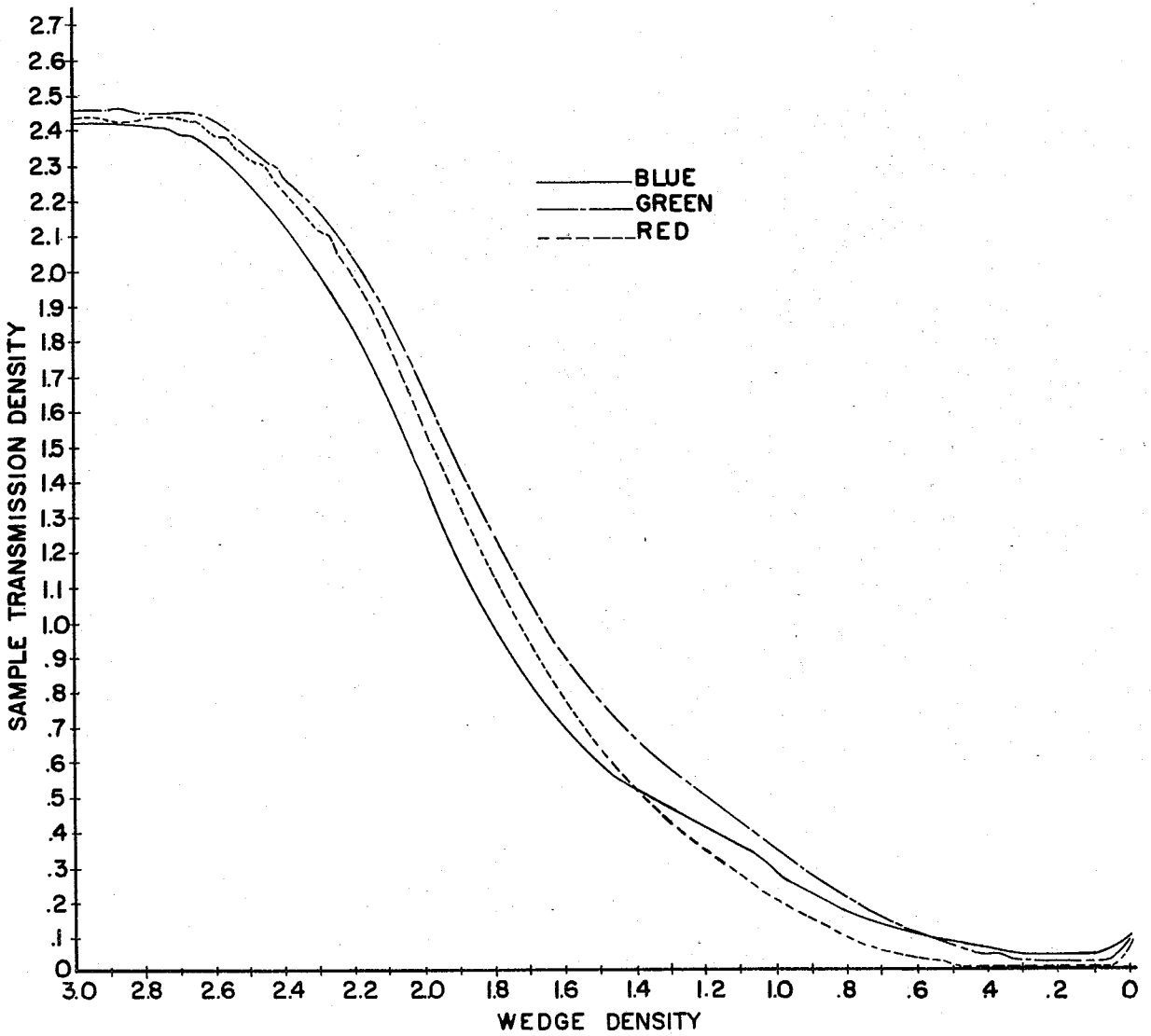

FIGS. 1–11 are the H&D curves for Examples 1–11, respectively, and were generated on an automatic recording densitometer. Densities and speeds obtained from the H&D curves are set forth in the Table. The $D_{mins}$ reported are density values above the density of the film base and color screen.

| Processing Composition A | Weight % |
|---|---|
| Sodium hydroxide | 8.81 |
| Hydroxyethyl cellulose (sold by Hercules, Inc., Wilmington, Delaware under the tradename Natrosol 250 HH) | 1.87 |
| Tetramethyl reductic acid | 7.36 |
| Potassium bromide | 0.64 |
| Sodium sulfite | 0.85 |
| 2-methylthiomethyl-4,6-dihydroxypyrimidine | 7.36 |
| 4-aminopyrazolo-[3,4d]-pyrimidine | 0.02 |
| N—benzyl-α-picolinium bromide (50% solution) | 3.68 |
| Water | 69.41 |

| Processing Composition B | Weight % |
|---|---|
| Sodium hydroxide | 8.54 |
| Hydroxyethyl cellulose (sold by Hercules, Inc., Wilmington, Delaware under the tradename Natrosol 250 HH) | 1.36 |
| Tetramethyl reductic acid | 5.83 |
| Potassium bromide | 0.68 |
| Sodium sulfite | 0.90 |
| 2-methylthiomethyl-4,6-dihydroxypyrimidine | 6.22 |
| 4-aminopyrazolo-[3,4d]-pyrimidine | 0.02 |
| N—benzyl-α-picolinium bromide (50% solution) | 3.11 |
| Water | 73.35 |

TABLE 1

| Example | Protective Layer mg/ft$^2$ as Coated | mg/ft$^2$ Ag | Dmax/Dmin Red | Dmax/Dmin Green | Dmax/Dmin Blue | 0.7 Speed Red | 0.7 Speed Green | 0.7 Speed Blue |
|---|---|---|---|---|---|---|---|---|
| 1 Control | 3.25 mg/ft$^2$ chitosan | 94.4 | 1.86/0 | 2.00/0.04 | 2.09/0.06 | 1.72 | 2.61 | 1.71 |
| 2 Control | 1.1 mg/ft$^2$ copper acetate<br>3.25 mg/ft$^2$ chitosan | 94.4 | 2.19/0 | 2.20/0.05 | 2.26/0.04 | 1.64 | 1.60 | 1.71 |
| 3 | 1.1 mg/ft$^2$ copper acetate<br>3.25 mg/ft$^2$ chitosan<br>0.65 mg/ft$^2$ glycerol | 94.2 | 2.23/0 | 2.25/0.05 | 2.25/0.05 | 1.62 | 1.60 | 1.75 |
| 4 Control | 3.3 mg/ft$^2$ copper acetate<br>9.75 mg/ft$^2$ chitosan | 95.3 | 2.42/0 | 2.44/0 | 2.36/0 | 1.58 | 1.50 | 1.74 |
| 5 | 3.3 mg/ft$^2$ copper acetate<br>9.75 mg/ft$^2$ chitosan<br>1.95 mg/ft$^2$ glycerol | 91.9 | 2.57/0 | 2.57/0.01 | 2.55/0.04 | 1.54 | 1.46 | 1.60 |
| 6 | 3.3 mg/ft$^2$ copper acetate<br>9.75 mg/ft$^2$ chitosan<br>5.2 mg/ft$^2$ glycerol | 91.1 | 2.38/0 | 2.49/0.03 | 2.48/0.04 | 1.62 | 1.54 | 1.65 |
| 7 | 3.3 mg/ft$^2$ copper acetate | 90.2 | 2.64/0 | 2.55/0.02 | 2.41/0.02 | 1.62 | 1.62 | 1.73 |

TABLE 1-continued

| Example | Protective Layer mg/ft² as Coated | mg/ft² Ag | Dmax/Dmin Red | Dmax/Dmin Green | Dmax/Dmin Blue | 0.7 Speed Red | 0.7 Speed Green | 0.7 Speed Blue |
|---|---|---|---|---|---|---|---|---|
| | 9.75 mg/ft² chitosan<br>5.2 mg/ft² sorbitol | | | | | | | |
| 8 | 3.3 mg/ft² copper acetate<br>9.75 mg/ft² chitosan<br>5.2 mg/ft² polyvinyl alcohol | 93.0 | 2.52/0 | 2.47/0.03 | 2.37/0.04 | 1.56 | 1.54 | 1.72 |
| 9 | 3.3 mg/ft² copper acetate<br>9.75 mg/ft² chitosan<br>5.2 mg/ft² inositol | 90.8 | 2.39/0 | 2.29/0.04 | 2.28/0.04 | 1.58 | 1.61 | 1.74 |
| 10 | 3.3 mg/ft² copper acetate<br>9.75 mg/ft² chitosan<br>5.2 mg/ft² ethylene glycol | 88.0 | 2.46/0.01 | 2.48/0.03 | 2.31/0.04 | 1.60 | 1.54 | 1.70 |
| 11 | 3.3 mg/ft² copper acetate<br>9.75 mg/ft² chitosan<br>5.2 mg/ft² propylene glycol | 94.1 | 2.44/0.01 | 2.45/0.02 | 2.42/0.05 | 1.55 | 1.46 | 1.66 |

Table 2, below, compares the spectrometric and stripping results with a prior art protective layer and a protective layer of the present invention employing a nonpolymer and a polymeric polyol. The film units were exposed at 16 mcs with a daylight balanced Xenon flash to a multicolor target and processed with mechanical rollers at 0.0016 in. gap disposing Processing Composition B between the top coat and a stripping sheet comprising a polyester base carrying a layer comprising 250 mg/ft² of gelatin and 25 mg/ft² of zinc acetate.

TABLE 2

| EX | Protective Layer mg/ft² as Coated | mg/ft² Ag | Dmax/Dmin Red | Dmax/Dmin Green | Dmax/Dmin Blue | 0.7 Speed Red | 0.7 Speed Green | 0.7 Speed Blue | Surface of Processed Protective Layer |
|---|---|---|---|---|---|---|---|---|---|
| 12 | 1.1 mg/ft² copper acetate<br>3.25 mg/ft² chitosan | 89.6 | 2.35/0.06 | 2.35/0.10 | 2.27/0.10 | 2.16 | 2.13 | 2.24 | Moderate visible residue |
| 13 | 1.1 mg/ft² copper acetate<br>3.25 mg/ft² chitosan<br>5.2 mg/ft² glycerol | 88.6 | 2.32/0.07 | 2.43/0.12 | 2.37/0.13 | 2.19 | 2.16 | 2.25 | Moderate visible residue |
| 14 | 1.1 mg/ft² copper acetate<br>3.25 mg/ft² chitosan<br>5.2 mg/ft² hydroxyethyl cellulose (Natrosol 250 HHP) | 88.6 | 2.45/0.06 | 2.44/0.12 | 2.33/0.09 | 2.21 | 2.19 | 2.28 | Very little visible residue |

From Table 2 it will be noted that some increase in density was achieved employing protective layers of the present invention. Cleaner stripping characteristics were achieved employing a protective layer with a polymeric polyol compared to a nonpolymeric polyol.

Table 3, below, compares the spectrometric and stripping results of a protective layer of the present invention employing a nonpolymeric polyol and another polymeric polyol. The film units were exposed at 16 mcs with a daylight balanced Xenon flash to a multicolor target and processed with mechanical rollers at 0.0020 in. gap disposing Processing Composition B between the top coat and a stripping sheet comprising a polyester base carrying a layer comprising 500 mg/ft² of gelatin and 50 mg/ft² of zinc acetate.

TABLE 3

| EX | Protective Layer mg/ft² as Coated | mg/ft² Ag | Dmax/Dmin Red | Dmax/Dmin Green | Dmax/Dmin Blue | 0.7 Speed Red | 0.7 Speed Green | 0.7 Speed Blue | Surface of Processed Protective Layer |
|---|---|---|---|---|---|---|---|---|---|
| 15 | 1.1 mg/ft² copper acetate<br>3.25 mg/ft² chitosan<br>5.2 mg/ft² glycerol | 94 | 2.43/0.09 | 2.48/0.12 | 2.38/0.13 | 2.21 | 2.18 | 2.30 | Moderate visible residue |
| 16 | 1.1 mg/ft² copper acetate<br>3.25 mg/ft² chitosan<br>5.2 mg/ft² polyvinyl alcohol | 93 | 2.22/0.05 | 2.23/0.09 | 2.14/0.11 | 2.27 | 2.25 | 2.33 | Very little visible residue |

From Table 3 it will be seen that, while better stripping characteristics were obtained with the specified polymeric polyol as well as a slight increase in speed, a density loss was noted compared with the nonpolymeric polyol.

The support employed in the present invention is not critical. The support or film base employed may comprise any of the various types of rigid or flexible supports. For example, glass, polymeric films of both the synthetic type and those derived from natural occurring products, including paper may be employed. If a transparency is desired, a transparent support is employed; if a reflection print is desired, an opaque support is employed. Especially suitable materials comprise flexible transparent synthetic polymers such as polymethacrylic acid; methyl and ethyl esters; vinyl chloride polymers; polyvinyl acetals; polyamides such as nylon; polyesters such as the polymeric film derived from ethylene glycol terethalic acid; polymeric cellulose derivatives such as cellulose acetate propionate; polycarbonates; polystyrenes and the like.

The additive color screen employed in the present invention may be formed by techniques well known in the art. For example, by sequentially printing the requisite filter patterns by photomechanical methods. An additive color screen comprises an array of sets of colored areas of filter elements usually from 2–4 different colors, each of said sets of colored areas being capable of transmitting visible light within a predetermined wavelength range. In the most common situations, the additive color screen is trichromatic and each set of color filter elements transmits light within one of the so-called primary wavelength ranges, i.e., red, green or blue. The additive color screen may be composed of minute dyed particles such as starch grains or hardened gelatin particles intermixed and interspersed in a regular or random arrangement to provide a mosaic. A regular mosaic of this type may be made by alternating embossing and doctoring technique described in U.S. Pat. No. 3,019,124. Another method of forming a suitable color screen comprises multi-line extrusion of the type disclosed in U.S. Pat. No. 3,032,008, the colored lines being deposited side-by-side in a single coating operation. Still another method is set forth in U.S. Pat. No. 3,284,208.

Silver halide solvents useful in forming the desired soluble complex with unexposed silver are well known and, for example may be selected from the alkali metal thiosulfates, such as sodium or potassium thiosulfates, or the silver halide solvent may be a cyclic imide, such as uracil, in combination with a nitrogenous base as taught in U.S. Pat. No. 2,857,274 issued Oct. 21, 1958 to Edwin H. Land or pseudouracils, such as the 4,6-dihydroxypyrimidines. While the silver halide solvent is preferably initially present in the processing composition, it is within this invention to initially position the silver halide solvent in a layer of the film unit, preferably in the form of a precursor which releases or generates the silver halide solvent upon contact with an alkaline processing fluid.

The processing composition may contain a thickening agent, such as an alkali metal carboxymethyl cellulose or hydroxyethyl cellulose, in a quantity and viscosity grade adapted to facilitate application of the processing composition. The requisite alkalinity, e.g., a pH of 12–14, is preferably imparted to the processing composition, by employing, for example, sodium, potassium and/or lithium hydroxide. A wetting agent may be advantageously included in the processing composition to facilitate application thereof, particularly where the processing composition is applied in a very thin layer of low viscosity fluid.

Suitable silver halide developing agents may be selected from amongst those known in the art, and may be initially positioned in a layer of the photosensitive element and/or in the processing composition. Organic silver halide developing agents are generally used, e.g., organic compounds of the benzene or naphthalene series containing hydroxyl and/or amino groups in the para- or ortho-positions with respect to each other, such as hydroquinone, tert-butyl hydroquinone, toluhydroquinone, p-aminophenol, 2,6-dimethyl-4-aminophenol, 2,4,6-triaminophenol, etc. If the additive color transparency is one which is not washed after processing to remove unused silver halide developing agent, development reaction products, etc., the silver halide developing agent(s) should not give rise to colored reaction products which might stain the image or which, either unreacted or reacted, might adversely affect the stability and sensitometric properties of the final image. Particularly useful silver halide developing agents having good stability in alkaline solution are substituted reductic acids, particularly tetramethyl reductic acid, as disclosed in U.S. Pat. No. 3,615,440 issued Oct. 26, 1971 to Stanley M. Bloom and Richard D. Cramer, and $\alpha,\beta$-endiols as disclosed in U.S. Pat. No. 3,730,716 issued to Edwin H. Land, Stanley M. Bloom and Leonard C. Farney on May 1, 1973.

We claim:

1. A silver diffusion transfer film unit which comprises a support carrying, in order, a layer comprising silver precipitating nuclei; a protective layer comprising a water soluble copper salt, chitosan and a polyol selected from the group consisting of glycerol, sorbitol, polyvinyl alcohol, inositol, ethylene glycol, propylene glycol and hydroxyethyl cellulose; a release layer; and a photosensitive silver halide emulsion layer.

2. The film unit of claim 1 wherein said support is transparent.

3. The film unit of claim 1 wherein said support is opaque.

4. The film unit of claim 2 which includes an additive color screen.

5. The film unit of claim 1 wherein said copper salt is copper acetate.

6. The film unit of claim 1 wherein the copper ion from said copper salt ranges from about 0.1 to 4 mg/ft$^2$; said chitosan ranges from about 1 to 20 mg/ft$^2$; and said polyol ranges from about 0.5 to 10 mg/ft$^2$.

7. The film unit of claim 6 wherein the ratio of chitosan to copper is about 10 to 1, by weight.

8. The film unit of claim 1 wherein said protective layer is about 2–50 mg/ft$^2$.

9. The film unit of claim 1 wherein said polyol is glycerol.

10. The film unit of claim 1 wherein said polyol is a polymeric polyol.

11. The film unit of claim 10 wherein said polyol is polyvinyl alcohol.

12. The film unit of claim 1 which includes a layer containing an antihalation compound.

13. The film unit of claim 1 wherein said silver precipitating nuclei are noble metal nuclei.

14. The film unit of claim 13 wherein said nuclei are palladium nuclei.

15. A photographic process which comprises the steps of:

(a) exposing a film unit which comprises a support carrying, in order, a layer comprising silver precipitating nuclei; a protective layer comprising a water soluble copper salt, chitosan and polyol selected from the group consisting of glycerol, sorbitol, polyvinyl alcohol, inositol, ethylene glycol, propylene glycol and hydroxyethyl cellulose; a release layer; and a photosensitive silver halide emulsion layer;

(b) contacting said exposed film unit with a processing composition containing a silver halide developing agent and a silver halide solvent adapted to provide a positive silver image in said layer comprising silver precipitating nuclei; and (c) removing said emulsion layer subsequent to positive image formation.

16. The process of claim 13 wherein said support is transparent.

17. The process of claim 13 wherein said support is opaque.

18. The process of claim 16 wherein said film unit includes an additive color screen.

19. The process of claim 15 wherein said copper salt is copper acetate.

20. The process of claim 15 wherein said protective layer is about 2–50 mg/ft$^2$.

21. The process of claim 15 wherein the copper ion from said copper salt ranges from about 0.1 to 4 mg/ft$^2$; said chitosan ranges from about 1 to 20 mg/ft$^2$; and said polyol ranges from about 0.5 to 10 mg/ft$^2$.

22. The process of claim 21 where the ratio of chitosan to copper ion is about 10 to 1, by weight.

23. The process of claim 15 wherein said polyol is glycerol.

24. The process of claim 15 wherein said polyol is polyvinyl alcohol.

25. The process of claim 15 wherein said film unit includes a layer containing an antihalation compound.

* * * * *